US008904798B2

(12) United States Patent
Manoharan et al.

(10) Patent No.: US 8,904,798 B2
(45) Date of Patent: Dec. 9, 2014

(54) COMBUSTOR

(75) Inventors: Madanmohan Manoharan, Bangalore (IN); Rahul R. Kulkarni, Bangalore (IN); Mahesh Bathina, Bangalore (IN)

(73) Assignee: General Electric Company, Schenectady, NY (US)

( * ) Notice: Subject to any disclaimer, the term of this patent is extended or adjusted under 35 U.S.C. 154(b) by 135 days.

(21) Appl. No.: 13/562,995

(22) Filed: Jul. 31, 2012

(65) Prior Publication Data

US 2014/0033718 A1 Feb. 6, 2014

(51) Int. Cl.
*F02C 1/00* (2006.01)
*F02G 3/00* (2006.01)

(52) U.S. Cl.
USPC ..... 60/737; 60/740

(58) Field of Classification Search
CPC ..... F23R 3/286; F23R 3/06; F23R 3/10; F23R 3/04
USPC ..... 60/737, 740, 752, 756
See application file for complete search history.

(56) References Cited

U.S. PATENT DOCUMENTS

| | | | |
|---|---|---|---|
| 233,397 | A | 10/1880 | Bradley |
| 3,771,500 | A | 11/1973 | Shakiba |
| 4,100,733 | A | 7/1978 | Striebel et al. |
| 4,104,873 | A | 8/1978 | Coffinberry |
| 4,412,414 | A | 11/1983 | Novick et al. |
| 4,429,527 | A | 2/1984 | Teets |
| 4,845,952 | A | 7/1989 | Beebe |
| 5,020,329 | A | 6/1991 | Ekstedt et al. |
| 5,104,310 | A | 4/1992 | Saltin |
| 5,205,120 | A | 4/1993 | Oblander et al. |
| 5,213,494 | A | 5/1993 | Jeppesen |
| 5,235,814 | A | 8/1993 | Leonard |
| 5,251,447 | A | 10/1993 | Joshi et al. |
| 5,341,645 | A | 8/1994 | Ansart et al. |
| 5,439,532 | A | 8/1995 | Fraas |
| 5,592,819 | A | 1/1997 | Ansart et al. |
| 5,603,213 | A | 2/1997 | Sion et al. |
| 5,685,139 | A | 11/1997 | Mick et al. |
| 5,707,591 | A | 1/1998 | Semedard et al. |
| 5,930,999 | A | 8/1999 | Howell et al. |
| 6,098,407 | A | 8/2000 | Korzendorfer et al. |
| 6,123,542 | A | 9/2000 | Joshi et al. |
| 6,301,899 | B1 | 10/2001 | Dean et al. |
| 6,394,791 | B2 | 5/2002 | Smith et al. |
| 6,438,961 | B2 | 8/2002 | Tuthill et al. |
| 6,672,073 | B2 | 1/2004 | Wiebe |
| 6,796,790 | B2 | 9/2004 | Venizelos et al. |

(Continued)

OTHER PUBLICATIONS

Mohamad Shaiful Ashrul Ishak Mohammad Nazri Mohd. Jaafrar, "The Effect of Swirl Number on Discharge Coefficient for Various Orifice Sizes in a Burner System" Journal Mekanikal, Jun. 2004, Bil. 17, 99-108.

*Primary Examiner* — Phutthiwat Wongwian
*Assistant Examiner* — William Breazeal
(74) *Attorney, Agent, or Firm* — Dority & Manning, P.A.

(57) ABSTRACT

A combustor includes a cap assembly that extends radially across at least a portion of the combustor, wherein the cap assembly includes an upstream surface axially separated from a downstream surface, and a combustion chamber downstream from the cap assembly. A plurality of tubes extend from the upstream surface through the downstream surface of the cap assembly, and each tube provides fluid communication through the cap assembly to the combustion chamber. The downstream surface is sloped at an angle with respect to the upstream surface.

14 Claims, 9 Drawing Sheets

(56) References Cited

U.S. PATENT DOCUMENTS

| | | | | |
|---|---|---|---|---|
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,107,772 | B2 | 9/2006 | Chen et al. | |
| 7,343,745 | B2 | 3/2008 | Inoue et al. | |
| 7,426,833 | B2 | 9/2008 | Yoshida et al. | |
| 7,540,154 | B2 | 6/2009 | Tanimura et al. | |
| 7,631,499 | B2 | 12/2009 | Bland | |
| 7,721,547 | B2 | 5/2010 | Bancalari et al. | |
| 7,732,899 | B1 | 6/2010 | Berry et al. | |
| 7,752,850 | B2 | 7/2010 | Laster et al. | |
| 7,886,991 | B2 * | 2/2011 | Zuo et al. | 239/13 |
| 8,007,274 | B2 | 8/2011 | Johnson et al. | |
| 8,104,284 | B2 | 1/2012 | Miura et al. | |
| 8,112,999 | B2 | 2/2012 | Zuo | |
| 8,141,334 | B2 | 3/2012 | Johnson et al. | |
| 8,147,121 | B2 | 4/2012 | Lacey et al. | |
| 8,157,189 | B2 | 4/2012 | Johnson et al. | |
| 8,181,891 | B2 | 5/2012 | Ziminsky et al. | |
| 2004/0216463 | A1 | 11/2004 | Harris | |
| 2005/0050895 | A1 | 3/2005 | Dorr et al. | |
| 2008/0016876 | A1 | 1/2008 | Colibaba-Evulet et al. | |
| 2008/0053097 | A1 * | 3/2008 | Han et al. | 60/737 |
| 2008/0302105 | A1 | 12/2008 | Oda et al. | |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0087394 | A1 | 4/2010 | Twydell | |
| 2010/0089367 | A1 | 4/2010 | Johnson et al. | |
| 2010/0095676 | A1 | 4/2010 | Uhm et al. | |
| 2010/0101229 | A1 | 4/2010 | York et al. | |
| 2010/0139280 | A1 * | 6/2010 | Lacy et al. | 60/737 |
| 2010/0180600 | A1 | 7/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2011/0265482 | A1 | 11/2011 | Parsania et al. | |
| 2012/0006030 | A1 | 1/2012 | Uhm et al. | |
| 2012/0079829 | A1 | 4/2012 | Berry et al. | |

* cited by examiner

COMBUSTOR

FIELD OF THE INVENTION

The present invention generally involves a combustor such as may be incorporated into a gas turbine or other turbomachine.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more fuel nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flame holding conditions in which the combustion flame migrates toward the fuel being supplied by the fuel nozzles, possibly causing accelerated wear to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, a plurality of tubes may be radially arranged in a cap assembly to provide fluid communication for the working fluid and fuel through the cap assembly and into the combustion chamber. Although effective at enabling higher operating temperatures while protecting against flame holding and controlling undesirable emissions, some fuels and operating conditions produce very high frequencies in the combustor. Increased vibrations in the combustor associated with high frequencies may reduce the useful life of one or more combustor components. Alternately, or in addition, high frequencies of combustion dynamics may produce pressure pulses inside the tubes and/or combustion chamber that may adversely affect the stability of the combustion flame, reduce the design margins for flame holding, and/or increase undesirable emissions. Therefore, a system that reduces resonant frequencies in the combustor would be useful to enhancing the thermodynamic efficiency of the combustor, protecting the combustor from accelerated wear, promoting flame stability, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a cap assembly that extends radially across at least a portion of the combustor, wherein the cap assembly includes an upstream surface axially separated from a downstream surface, and a combustion chamber downstream from the cap assembly. A plurality of tubes extend from the upstream surface through the downstream surface of the cap assembly, and each tube provides fluid communication through the cap assembly to the combustion chamber. The downstream surface is sloped at an angle with respect to the upstream surface.

Another embodiment of the present invention is a combustor that includes a cap assembly that extends radially across at least a portion of the combustor, wherein the cap assembly comprises an upstream surface axially separated from a downstream surface, and a combustion chamber downstream from the cap assembly. A plurality of tubes extend from the upstream surface through the downstream surface of the cap assembly. Each tube includes an inlet proximate to the upstream surface, an outlet proximate to the downstream surface, and the outlet is sloped at an angle with respect to the inlet.

The present invention may also include a combustor that includes a cap assembly that extends radially across at least a portion of the combustor, wherein the cap assembly comprises an axial centerline and an upstream surface axially separated from a downstream surface. A fuel nozzle is substantially aligned with the axial centerline of the cap assembly. A plurality of tubes are circumferentially arranged around the fuel nozzle and extend from the upstream surface through the downstream surface of the cap assembly. Each tube comprises an inlet proximate to the upstream surface, an outlet proximate to the downstream surface, and the outlet is sloped at an angle with respect to the inlet.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
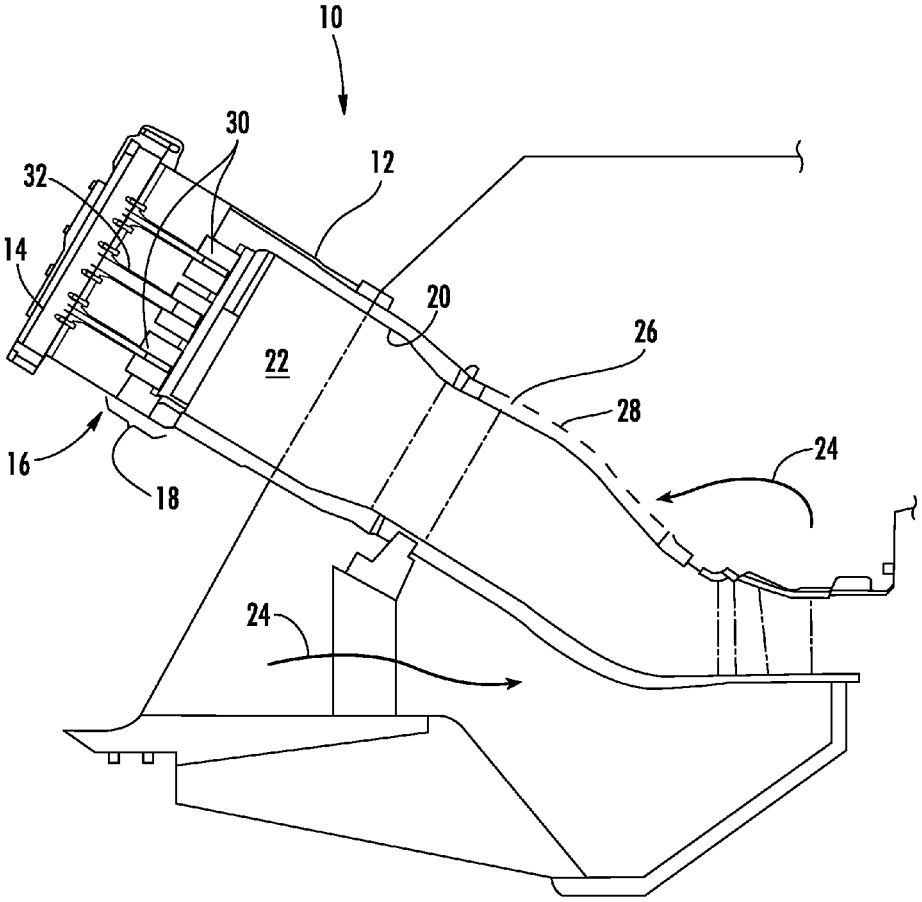
FIG. 1 is a simplified cross-section view of an exemplary combustor according to various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor that reduces combustion dynamics while enhancing the thermodynamic efficiency, promoting flame stability, and/or reducing undesirable emissions over a wide range of combustor operating levels. In general, a cap assembly may extend radially across at least a portion of the combustor, and a plurality of tubes radially arranged across the cap assembly may provide fluid communication through the cap assembly to a combustion chamber downstream from the cap assembly. In particular embodiments, a downstream surface of the cap assembly may be sloped to produce tubes of varying length across the cap assembly. Alternately or in addition, an outlet of the tubes may be sloped. The different tube lengths and/or sloped outlets may decouple the natural frequency of the combustion dynamics, reduce flow instabilities, and/or axially distribute the combustion flame across the downstream surface of the cap assembly. As a result, various embodiments of the present invention may allow extended combustor operating conditions, extend the life and/or maintenance intervals for various combustor components, maintain adequate design margins of flame holding, and/or reduce undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as may be included in a gas turbine or other turbo-machine, according to various embodiments of the present invention. The combustor 10 generally includes a casing 12 that circumferentially surrounds at least a portion of the combustor 10 to contain a working fluid flowing to the combustor 10. As shown in FIG. 1, the casing 12 may be connected to or include an end cover or breech end 14 that extends radially across at least a portion of the combustor 10 to provide an interface for supplying fuel, diluents, and/or other additives to the combustor 10. In addition, the casing 12 and breech end 14 may combine to at least partially define a head end 16 inside the combustor 10. A cap assembly 18 downstream from the head end 16 may extend radially across at least a portion of the combustor 10, and a liner 20 connected to the cap assembly 18 may at least partially define a combustion chamber 22 downstream from the cap assembly 18. A working fluid 24 may flow, for example, through flow holes 26 in an impingement sleeve 28 and along the outside of the liner 20 to provide convective cooling to the liner 20. When the working fluid 24 reaches the head end 16, the working fluid 24 reverses direction to flow through the cap assembly 18 and into the combustion chamber 22.

Figure 2:
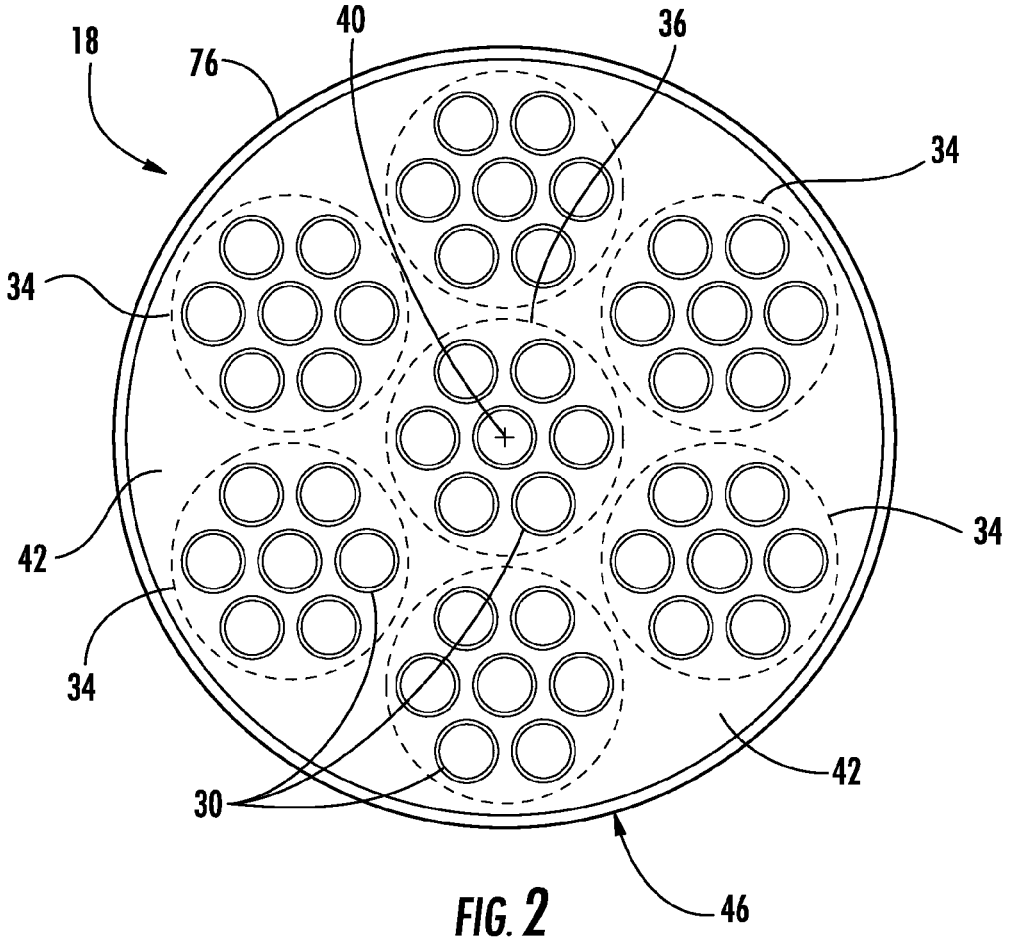
FIG. 2 is an upstream plan view of the cap assembly shown in FIG. 1 according to an embodiment of the present invention.
Figure 3:
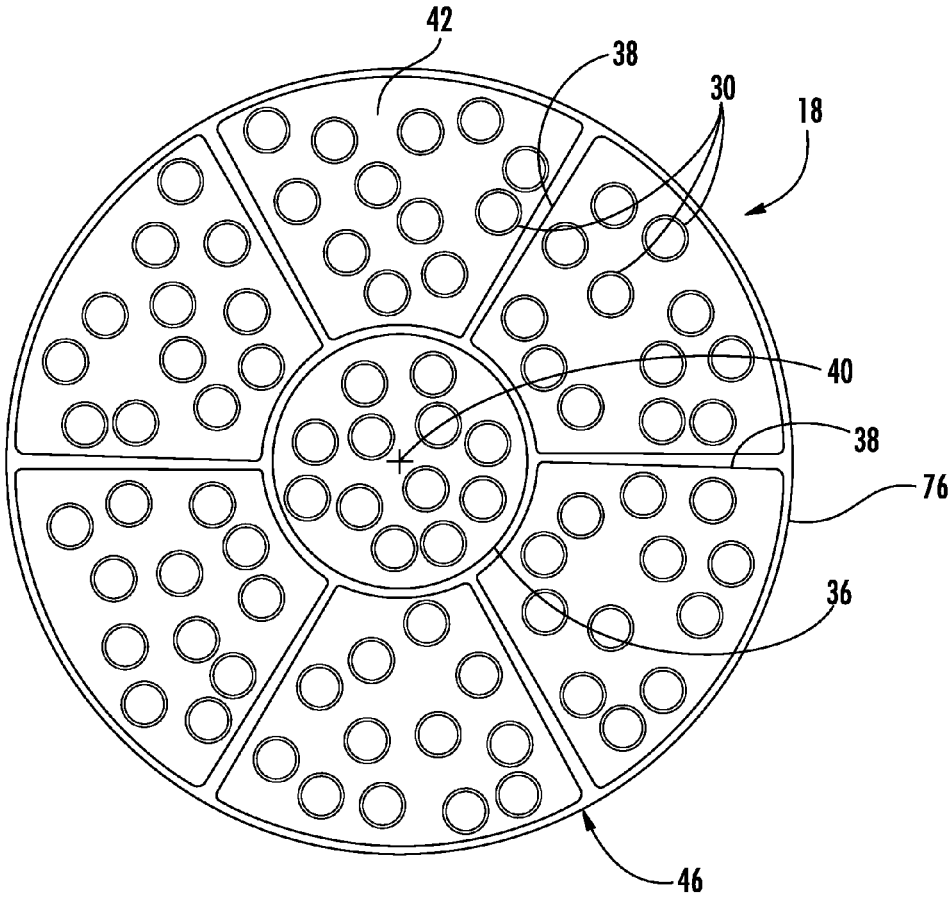
FIG. 3 is an upstream plan view of the cap assembly shown in FIG. 1 according to an alternate embodiment of the present invention.

The cap assembly 18 generally includes a plurality of tubes 30 and/or one or more fuel nozzles 32 that provide fluid communication through the cap assembly 18 and into the combustion chamber 22. Although generally shown as cylindrical, the radial cross-section of the tubes 30 and/or fuel nozzles 32 may be any geometric shape, and the present invention is not limited to any particular radial cross-section unless specifically recited in the claims. In addition, various embodiments of the combustor 10 may include different numbers and arrangements of tubes 30 and fuel nozzles 32 in the cap assembly 18, and FIGS. 2-5 provide upstream plan views of exemplary arrangements of the tubes 30 and fuel nozzles 32 in the cap assembly 18 within the scope of the present invention. As shown in FIGS. 2 and 3, for example, the tubes 30 may be radially arranged across the entire cap assembly 18, and the tubes 30 may be divided into various groups to facilitate multiple fueling regimes over the combustor's 10 range of operations. For example, the tubes 30 may be grouped in a plurality of circular tube bundles 34 that circumferentially surround a center tube bundle 36, as shown in FIG. 2. Alternately, as shown in FIG. 3, a plurality of pie-shaped tube bundles 38 may circumferentially surround the center tube bundle 36. During base load operations, fuel may be supplied to each tube bundle 34, 36, 38, while fuel flow may be reduced or completely eliminated from the center tube bundle 36 and/or one or more circumferentially arranged circular or pie-shaped tube bundles 34, 38 during reduced or turndown operations.

Figure 4:
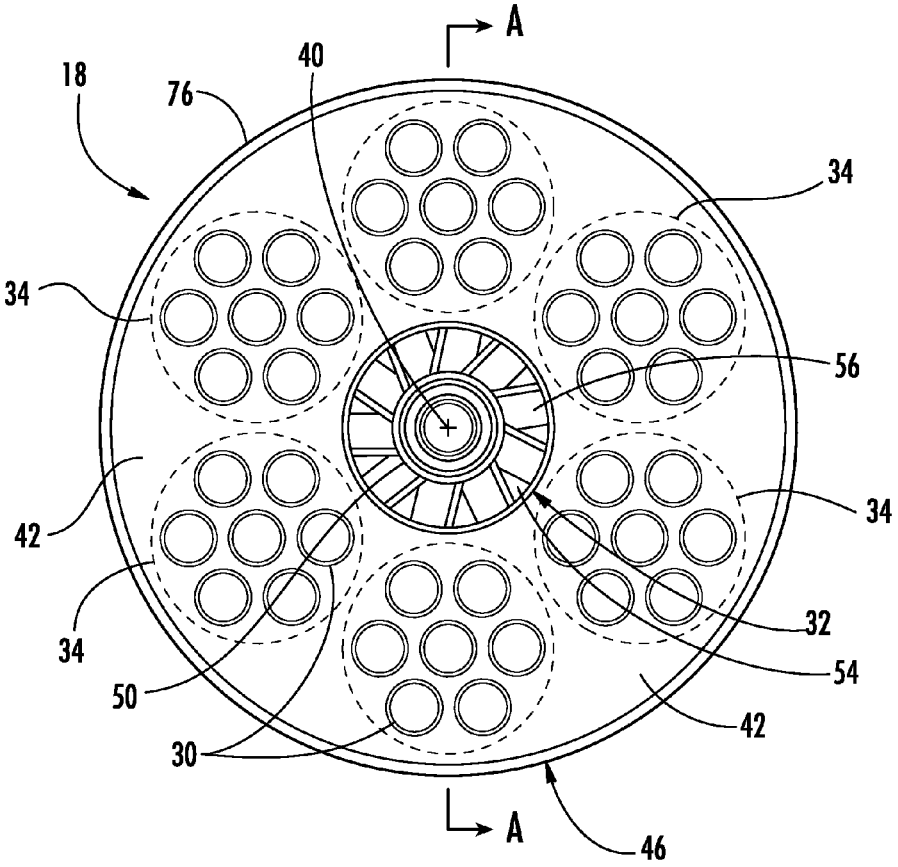
FIG. 4 is an upstream plan view of the cap assembly shown in FIG. 1 according to an alternate embodiment of the present invention.
Figure 5:
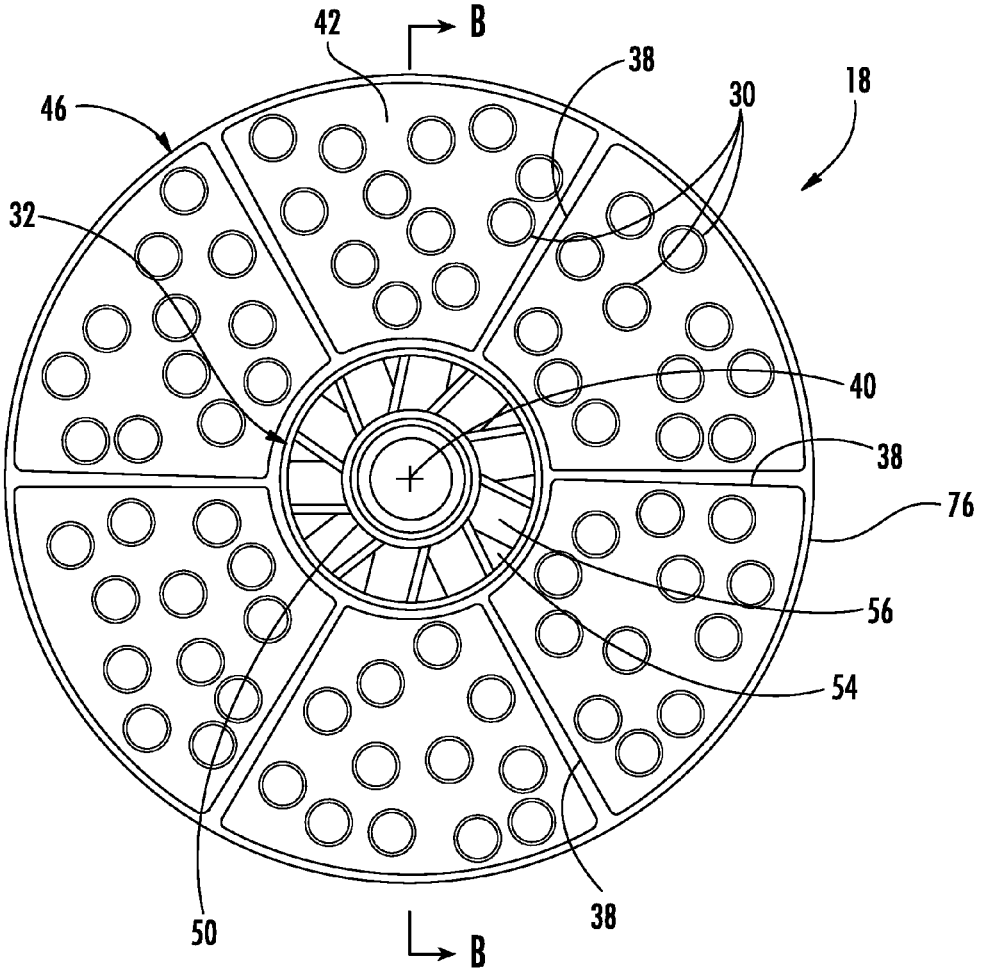
FIG. 5 is an upstream plan view of the cap assembly shown in FIG. 1 according to an alternate embodiment of the present invention.

In the particular embodiments shown in FIGS. 4 and 5, the fuel nozzle 32 is substantially aligned with an axial centerline 40 of the cap assembly 18, and the circular and pie-shaped tube bundles 34, 38 are circumferentially arranged around the fuel nozzle 32, respectively. As with the embodiments shown in FIGS. 2 and 3, fuel may be supplied to the fuel nozzle 32 and each tube bundle 34, 38 during base load operations, while fuel flow may be reduced or completely eliminated from the fuel nozzle 32 and/or one or more circumferentially arranged circular or pie-shaped tube bundles 34, 38 during reduced or turndown operations. One of ordinary skill in the art will readily appreciate multiple other shapes and arrangements for the tube bundles from the teachings herein, and the particular shape and arrangement of the tube bundles is not a limitation of the present limitation unless specifically recited in the claims.

FIGS. 6-9 provide side cross-section views or upstream partial perspective and cross-section views of various embodiments within the scope of the present invention. In each embodiment, the cap assembly 18 includes a sloped downstream surface 42 and/or the tubes 30 include sloped outlets that result in tubes 30 of varying axial lengths across the cap assembly 18. The direction and curvature of the slope in the downstream surface 42 and/or tube outlets may vary according to particular embodiments. In some embodiments, for example, the downstream surface 42 and/or tube outlets may be sloped downstream from an outer perimeter 46 of the cap assembly 18, while in other embodiments the downstream surface 42 and/or tube outlets may be sloped upstream from the outer perimeter 46 of the cap assembly 18. Similarly, the downstream surface 42 and/or tube outlets may be concave or convex, depending on the particular embodiment.

Figure 6:
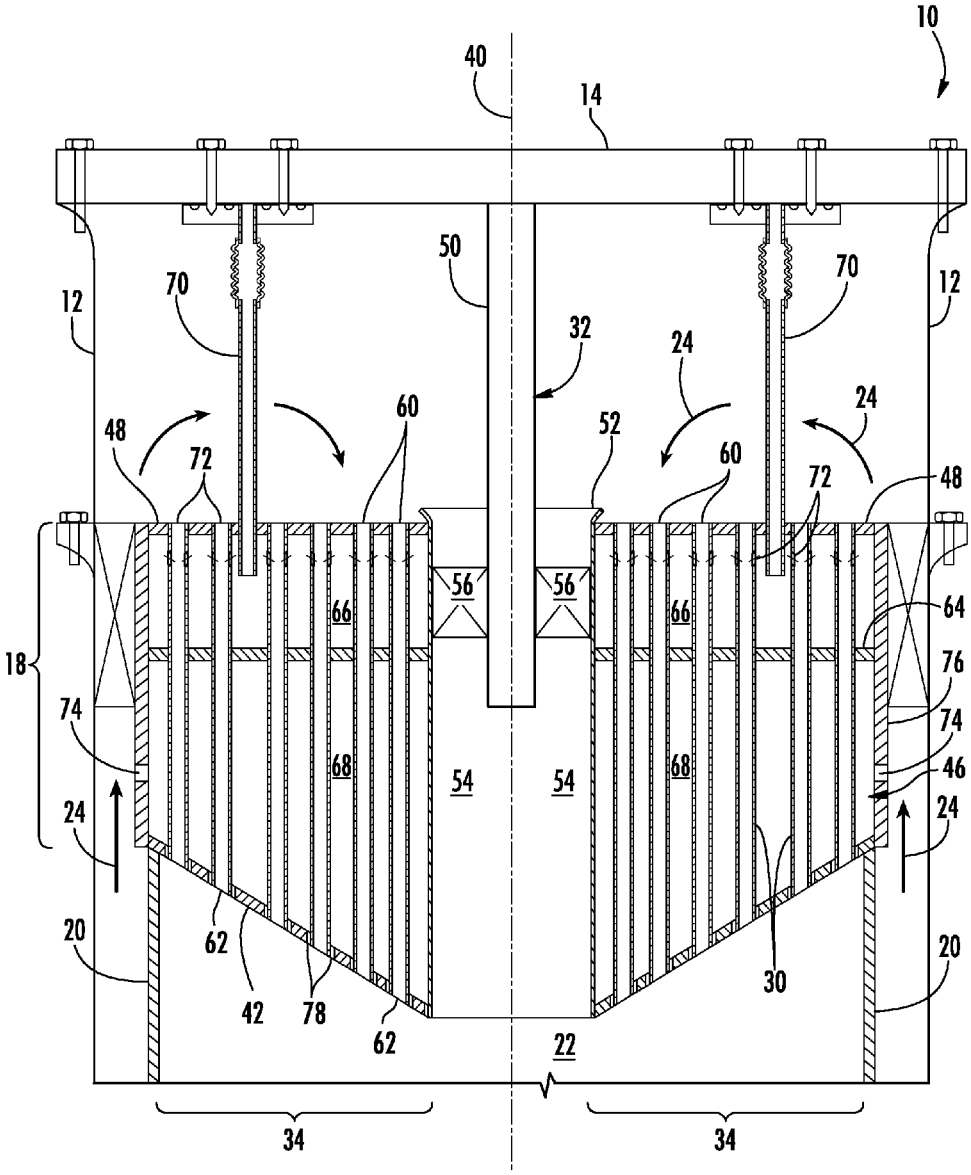
FIG. 6 is a side cross-section view of the head end of the combustor shown in FIG. 4 taken along line A-A according to a first embodiment of the present invention.

FIG. 6 provides a side cross-section view of a portion of the combustor 10 shown in FIG. 4 taken along line A-A according to a first embodiment of the present invention. As shown, the cap assembly 18 extends radially across at least a portion of the combustor 10 and includes an upstream surface 48 axially separated from the downstream surface 42. The upstream surface 48 may be generally flat or straight and oriented perpendicular to the general flow of the working fluid 24 through the cap assembly 18. In contrast, the downstream surface 42 may be sloped at an angle with respect to the upstream surface 48. In the particular embodiment shown in FIG. 6, the downstream surface 42 is sloped downstream from the outer perimeter 46 of the cap assembly 18, and the angle of the slope may vary between 10 and 75 degrees, depending on the particular embodiment and location in the combustor 10.

In the particular embodiment shown in FIG. 6, the fuel nozzle 32 is substantially aligned with the axial centerline 40 of the cap assembly 18 and extends through the cap assembly 18 to provide fluid communication through the cap assembly 18 to the combustion chamber 22. The fuel nozzle 32 may include any suitable structure known to one of ordinary skill in the art for mixing fuel with the working fluid 24 prior to entry into the combustion chamber 22, and the present invention is not limited to any particular structure or design unless specifically recited in the claims. For example, as shown in FIG. 6, the fuel nozzle 32 may include a center body 50 and a bellmouth opening 52. The center body 50 may provide fluid communication for fuel to flow from the end cover 14, through the center body 50, and into the combustion chamber 22. The bellmouth opening 52 may surround at least a portion of the center body 50 to define an annular passage 54 between the center body 50 and the bellmouth opening 52. In this manner, the working fluid 24 may flow through the annular passage 54 to mix with the fuel from the center body 50 prior to reaching the combustion chamber 22. If desired, the fuel nozzle 32 may further include one or more swirler vanes 56 that extend radially between the center body 50 and the bellmouth opening 52 to impart swirl to the fuel-working fluid mixture prior to reaching the combustion chamber 22.

As shown in FIGS. 4 and 6, the tubes 30 may be circumferentially arranged around the fuel nozzle 32 and extend from the upstream surface 48 through the downstream surface 42 of the cap assembly 18. Each tube 30 generally includes an inlet 60 proximate to the upstream surface 48 and an outlet 62 proximate to the downstream surface 42. As shown in FIG. 6, the tube inlets and outlets 60, 62 may be flush with the upstream and downstream surfaces 48, 42, respectively. As a result, adjacent tubes 30 may have different axial lengths, and each outlet 62 may be sloped at an angle with respect to the corresponding inlet 60. In the particular embodiment shown in FIG. 6, each outlet 62 is sloped downstream from the outer perimeter 46 of the cap assembly 18, resulting in longer tubes 30 toward the center of the cap assembly 18 and non-circular cross-sections for each outlet 62.

As further shown in FIG. 6, a barrier 64 may extend radially inside the cap assembly 18 between the upstream and downstream surfaces 48, 42 to separate a fuel plenum 66 from a fluid plenum 68 inside the cap assembly 18. A fuel conduit 70 may extend from the casing 12 and/or end cover 14 through the upstream surface 48 to provide fluid communication for fuel to flow into the fuel plenum 66. One or more of the tubes 30 may include a fuel port 72 that provides fluid communication from the fuel plenum 66 through the one or more tubes 30. The fuel ports 72 may be angled radially, axially, and/or azimuthally to project and/or impart swirl to the fuel flowing through the fuel ports 72 and into the tubes 30. The working fluid 24 may thus flow into the tube inlets 60, and fuel from the fuel conduit 70 may flow around the tubes 30 in the fuel plenum 66 to provide convective cooling to the tubes 30 before flowing through the fuel ports 72 and into the tubes 30 to mix with the working fluid 24. The fuel-working fluid mixture may then flow through the tubes 30 and into the combustion chamber 22.

In addition, fluid passages 74 provide fluid communication through a shroud 76 surrounding the cap assembly 18 into the fluid plenum 68. In this manner, the working fluid 24 may flow through the fluid passages 74 and around the tubes 30 to provide convective cooling to the tubes 30 in the fluid plenum 68 before flowing through fluid ports 78 in the downstream surface 42 to cool the downstream surface 42 adjacent to the combustion chamber 22. In addition to cooling the downstream surface 42, the working fluid 24 supplied through the downstream surface 42 further assists in decoupling the natural frequency of the combustion dynamics, tailoring flow instabilities, and/or axially distributing the combustion flame across the downstream surface 42 of the tube bundles 34, 38 to reduce $NO_X$ production.

The combination of the sloped outlets 62, non-circular cross-sections of the outlets 62, and varying axial lengths of the tubes 30 produces slightly different convection times for fuel and working fluid 24 flowing through each tube 30. The slightly different convection times, varying axial positions of the outlets 62, and/or working fluid 24 flow through the fluid ports 78 may reduce interaction between adjacent flames, resulting in reduced combustion dynamics and more stable combustion flames. The different axial lengths of the tubes 30 produced by the sloped downstream surface 42 and/or tube outlets 62 thus decouple the natural frequency of the combustion dynamics, tailor flow instabilities downstream from the downstream surface 42, and/or axially distribute the combustion flame across the downstream surface 42 of the tubes 30 to reduce $NO_X$ production during base load operations. In addition, during turndown operations when only working fluid 24 may flow through the center fuel nozzle 32, the slope of the tube outlets 62 may reduce or prevent the working fluid 24 flowing through the center fuel nozzle 32 from prematurely quenching the combustion flame associated with the adjacent tube outlets 62, reducing the production of carbon monoxide and other unburned hydrocarbons during turndown operations.

Figure 7:
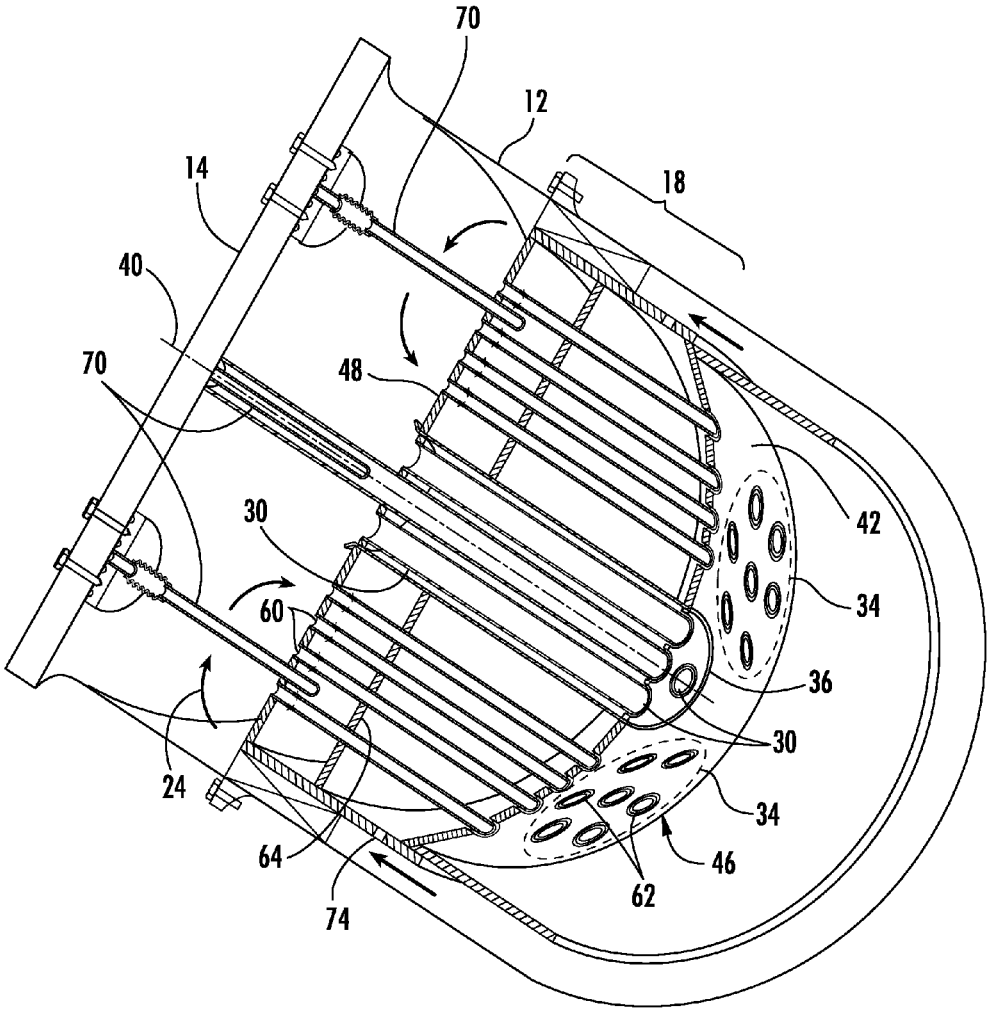
FIG. 7 is an upstream partial perspective and cross-section view of the cap assembly shown in FIG. 2 according to a second embodiment of the present invention.

FIG. 7 provides an upstream partial perspective and cross-section view of the cap assembly 18 shown in FIG. 2 according to a second embodiment of the present invention. This embodiment may again include the upstream surface 48, tubes 30, barrier 64, fuel plenum 66, and fluid plenum 68 as previously described with respect to FIG. 6. In this particular embodiment, the downstream surface 42 is again sloped downstream from the outer perimeter 46 of the cap assembly 18, and the downstream surface 42 is also convex. As a result, adjacent tubes 30 may again have different axial lengths, with longer tubes 30 toward the center of the cap assembly 18. In addition, each outlet 62 may be sloped at an angle with respect to the corresponding inlet 60 with a convex curvature and non-circular cross-section.

Figure 8:
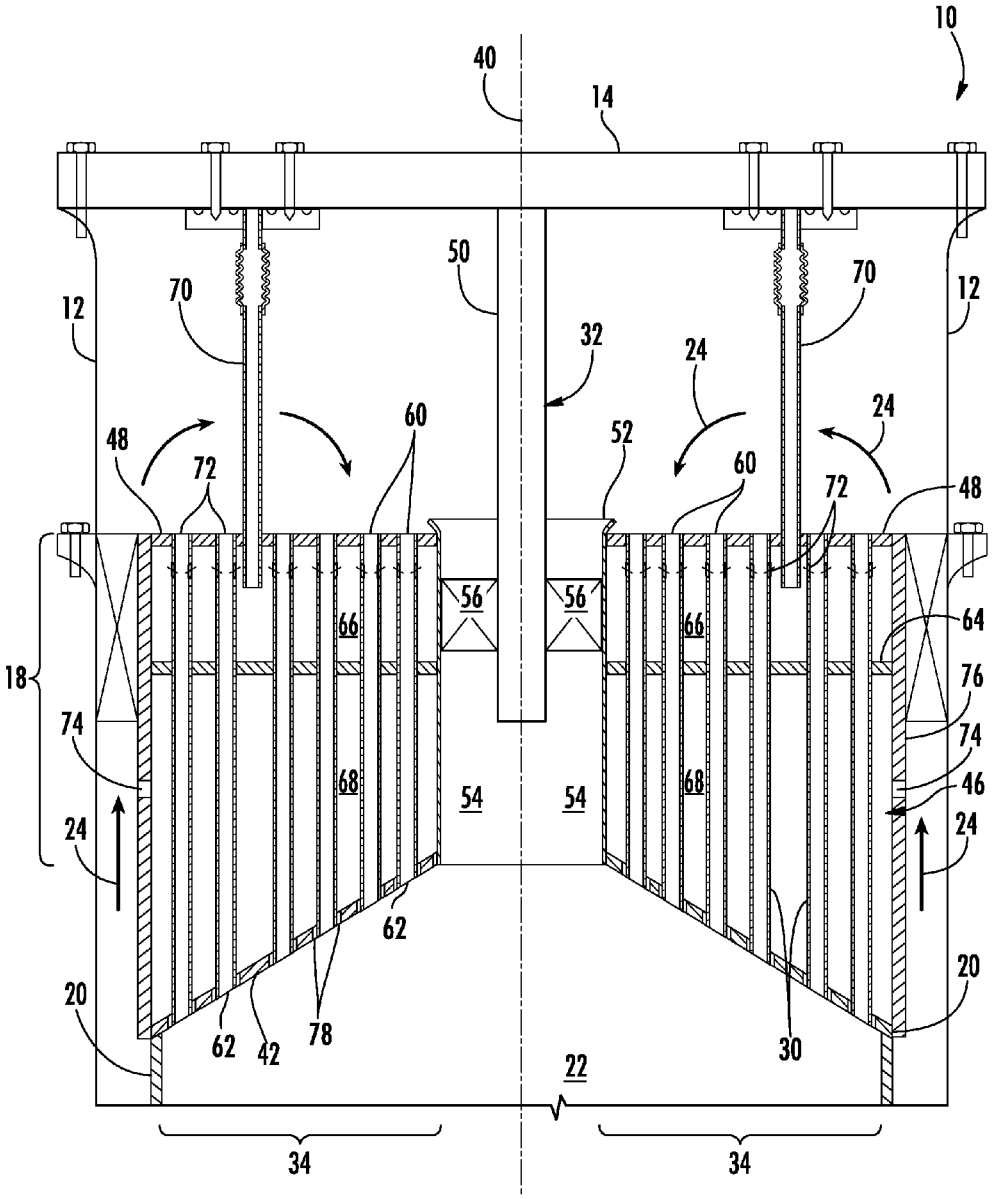
FIG. 8 is a side cross-section view of the head end of the combustor shown in FIG. 5 taken along line B-B according to a third embodiment of the present invention.

FIG. 8 provides a side cross-section view of a portion of the combustor shown in FIG. 5 taken along line B-B according to a third embodiment of the present invention. This embodiment may again include the upstream surface 48, tubes 30, barrier 64, fuel plenum 66, and fluid plenum 68 as previously described with respect to FIG. 6. In this particular embodiment, the downstream surface 42 is sloped upstream from the outer perimeter 46 of the cap assembly 18. As a result, adjacent tubes 30 may again have different axial lengths, with longer tubes 30 toward the outer perimeter 46 of the cap assembly 18. In addition, each outlet 62 may be sloped at an angle with respect to the corresponding inlet 60 with a non-circular cross-section.

Figure 9:
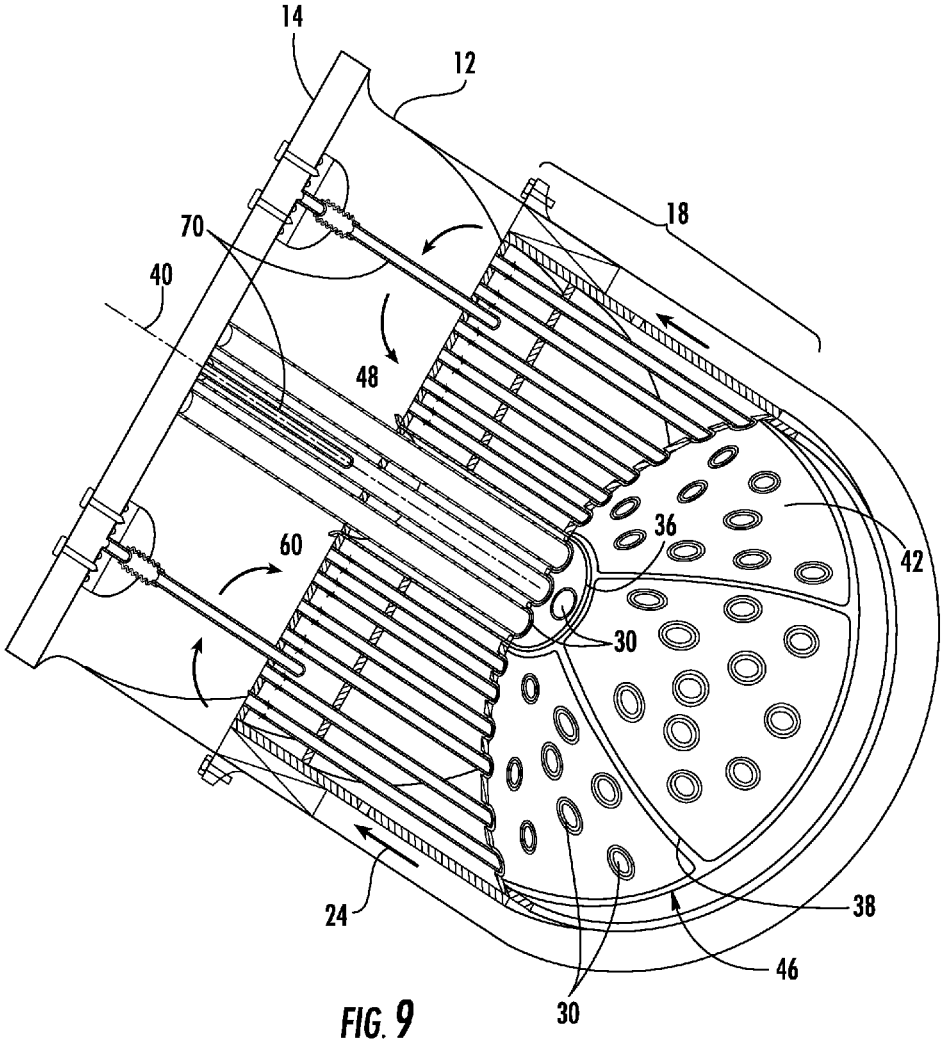
FIG. 9 is an upstream partial perspective and cross-section view of the cap assembly shown in FIG. 3 according to a fourth embodiment of the present invention.

FIG. 9 provides an upstream partial perspective and cross-section view of the cap assembly 18 shown in FIG. 3 according to a fourth embodiment of the present invention. This embodiment may again include the upstream surface 48, tubes 30, barrier 64, fuel plenum 66, and fluid plenum 68 as previously described with respect to FIG. 6. In this particular embodiment, the downstream surface 42 is again sloped upstream from the outer perimeter 46 of the cap assembly 18, and the downstream surface 42 is also concave. As a result, adjacent tubes 30 may again have different axial lengths, with longer tubes 30 toward the outer perimeter 46 of the cap assembly 18. In addition, each outlet 62 may be sloped at an angle with respect to the corresponding inlet 60 with a concave curvature and non-circular cross-section.

The various embodiments described and illustrated with respect to FIGS. 1-9 may provide one or more of the following advantages over existing nozzles and combustors. Specifically, the sloped downstream surface 42, different axial lengths of the tubes 30, sloped tube outlets 62, and/or fluid ports 78, alone or in various combinations may decouple the natural frequency of the combustion dynamics, tailor flow instabilities, and/or axially distribute the combustion flame across the downstream surface 42 of the tubes 30 to reduce $NO_X$ production during base load operations and/or carbon monoxide and other unburned hydrocarbon production during turndown operations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor comprising:

a cap assembly that extends radially across at least a portion of the combustor, wherein the cap assembly comprises an upstream surface axially separated from a downstream surface along an axial centerline;

a combustion chamber downstream from the cap assembly;

a plurality of tubes that extend from the upstream surface through the downstream surface of the cap assembly, wherein each tube provides fluid communication through the cap assembly to the combustion chamber; and wherein the entire downstream surface is sloped at an angle with respect to the upstream surface towards the axial centerline, and wherein the slope of the entire downstream surface is one of downstream or upstream from an outer perimeter of the cap assembly.

2. The combustor as in claim 1, wherein the downstream surface is sloped downstream from an outer perimeter of the cap assembly.

3. The combustor as in claim 1, wherein the downstream surface has a concave curvature.

4. The combustor as in claim 1, wherein the downstream surface has a convex curvature.

5. The combustor as in claim 1, wherein each tube comprises an outlet proximate to the downstream surface, and the outlet defines a non-circular cross-section.

6. The combustor as in claim 1, further comprising a barrier that extends radially inside the cap assembly between the upstream and downstream surfaces to separate a fuel plenum from a fluid plenum inside the cap assembly.

7. The combustor as in claim 6, further comprising a plurality of fluid ports through the downstream surface, wherein the plurality of fluid ports provides fluid communication from the fluid plenum through the downstream surface.

8. The combustor as in claim 6, further comprising a plurality of fuel ports through the plurality of tubes, wherein the plurality of fuel ports provides fluid communication from the fuel plenum through the plurality of tubes.

9. The combustor as in claim 1, further comprising a fuel nozzle substantially aligned with an axial centerline of the cap assembly, wherein the plurality of tubes circumferentially surround the fuel nozzle.

10. A combustor comprising:

a cap assembly that extends radially across at least a portion of the combustor, wherein the cap assembly comprises an upstream surface axially separated from a downstream surface along an axial centerline;

a combustion chamber downstream from the cap assembly; and a plurality of tubes that extend from the upstream surface through the downstream surface of the cap assembly, wherein each tube comprises an inlet proximate to the upstream surface, an outlet proximate to the downstream surface, and the outlet is sloped at an angle with respect to the inlet, and wherein the entire downstream surface is sloped at an angle with respect to the upstream surface towards the axial centerline, and wherein the slope of the entire downstream surface is one of downstream or upstream from an outer perimeter of the cap assembly.

11. The combustor as in claim 10, wherein each outlet s sloped downstream from an outer perimeter of the cap assembly.

12. The combustor as in claim 10, wherein each outlet has a concave curvature.

13. The combustor as in claim 10, wherein each outlet has a convex curvature.

14. The combustor as in claim 10, wherein the downstream surface has a concave curvature.

* * * * *

UNITED STATES PATENT AND TRADEMARK OFFICE

CERTIFICATE OF CORRECTION

PATENT NO. : 8,904,798 B2
APPLICATION NO. : 13/562995
DATED : December 9, 2014
INVENTOR(S) : Madanmohan Manoharan et al.

It is certified that error appears in the above-identified patent and that said Letters Patent is hereby corrected as shown below:

In the claims

In Column 8, line 58, delete "outlet s" and insert --outlet is--

Signed and Sealed this
Fifth Day of April, 2016

Michelle K. Lee

Michelle K. Lee
*Director of the United States Patent and Trademark Office*